US006052636A

United States Patent [19]

Lombardi

[11] Patent Number: 6,052,636

[45] Date of Patent: Apr. 18, 2000

[54] APPARATUS AND METHOD FOR POSITIONING AN EXCAVATOR HOUSING

[75] Inventor: Frank Lombardi, Peoria, Ill.

[73] Assignee: Caterpillar Inc., Peoria, Ill.

[21] Appl. No.: 08/905,510

[22] Filed: Aug. 4, 1997

[51] Int. Cl.[7] ..... G05D 16/00

[52] U.S. Cl. ..... 701/50; 701/53; 701/49; 318/645; 172/4.5; 388/929

[58] Field of Search ..... 701/50, 53, 49; 318/645; 172/4.5; 388/929

[56] References Cited

U.S. PATENT DOCUMENTS

| | | | |
|---|---|---|---|
| 4,586,332 | 5/1986 | Schexnayder | 60/468 |
| 5,363,304 | 11/1994 | Awano et al. | 701/50 |
| 5,448,148 | 9/1995 | Devier | 318/645 |
| 5,528,498 | 6/1996 | Scholl | 364/424.07 |
| 5,699,247 | 12/1997 | Moriya et al. | 701/50 |
| 5,704,429 | 1/1998 | Lee et al. | 701/50 |
| 5,768,810 | 6/1998 | Ahn | 701/50 |

FOREIGN PATENT DOCUMENTS 0 461 258 12/1991 European Pat. Off. .

OTHER PUBLICATIONS

Advance modern control system theory and design, Stanley M. Shinners, pp. 6,7,516,517,574–585.

*Primary Examiner*—William A. Cuchlinski, Jr.
*Assistant Examiner*—Olga Hernandez
*Attorney, Agent, or Firm*—Steve D. Lundquist

[57] ABSTRACT

An apparatus and method for rotatably positioning a machine housing is disclosed. A pump produces pressurized fluid to a motor that responsively rotates the machine housing. A control valve regulates fluid flow from the pump to the motor. A position sensor detects the rotational position of the housing and responsively produces an actual position signal. A device produces a signal indicative of a desired rotational position of the housing. A controller compares the desired and actual position signals, responsively produces an error signal, multiplies the error signal by a variable gain value representative of the housing acceleration and delivers a control signal to the control valve to rotate the housing to the desired position.

13 Claims, 3 Drawing Sheets

APPARATUS AND METHOD FOR POSITIONING AN EXCAVATOR HOUSING

TECHNICAL FIELD

This invention relates generally to an apparatus for positioning an excavator housing and, more particularly, to an apparatus for positioning an excavator housing using acceleration feedback.

BACKGROUND ART

A typical excavator housing positioning system includes a hydraulic motor that rotates a gear assembly associated with a swing gear train, which in turn, rotates the housing. A closed loop control system may be used to position the excavator housing to a desired position. In application, an operator rotates the excavator housing to a desired position by accelerating the housing from a start position and decelerating the housing prior to reaching the desired position. However, the inertial forces created by a rotating housing with a varying load make it difficult, even for the expert operator, to accurately rotate the housing to a desired position. In particular, once the excavator begins rotational motion, the inertia caused by the rotation typically causes the housing to overshoot the desired position. This problem is further exacerbated when the excavator is working on a hill side or the work implement of the excavator is carrying a full load.

Moreover, with the development of automated controls that regulate the dig and dump cycle of the excavator, a method is needed to monitor the inertial forces present during the rotational motion of the excavator in order to compensate for the inertial forces to accurately control the rotation. Unfortunately, directly monitoring inertial forces requires the use of several sensors, which add to the cost of the machine.

The present invention is directed toward overcoming one or more of the problems as set forth above.

DISCLOSURE OF THE INVENTION

In one aspect of the present invention, an apparatus and method for rotatably positioning a machine housing is disclosed. A pump supplies pressurized fluid to a motor that responsively rotates the machine housing. A control valve regulates fluid flow from the pump to the motor. A position sensor detects the rotational position of the housing and responsively produces an actual position signal. A device produces a signal indicative of a desired rotational position of the housing. A controller compares the desired and actual position signals, responsively produces an error signal, multiplies the error signal by a variable gain value representative of the housing acceleration and delivers a control signal to the control valve to rotate the housing to the desired position.

BRIEF DESCRIPTION OF THE DRAWINGS

For a better understanding of the present invention, reference may be made to the accompanying drawings in which.

BEST MODE FOR CARRYING OUT THE INVENTION

The present invention is particularly suited to controlling the rotational position of an excavator housing. Although the present invention will be discussed in relation to the positioning of an excavator housing, the present invention is equally applicable to any type of rotating machine, including front shovels. The present invention makes use of the principle that acceleration is inversely proportional to the forces of inertia assuming that torque is constant. Thus, once the rotational acceleration of the excavator housing is determined, then the forces of inertia can be accounted for in the positioning of the excavator housing.

Figure 1:
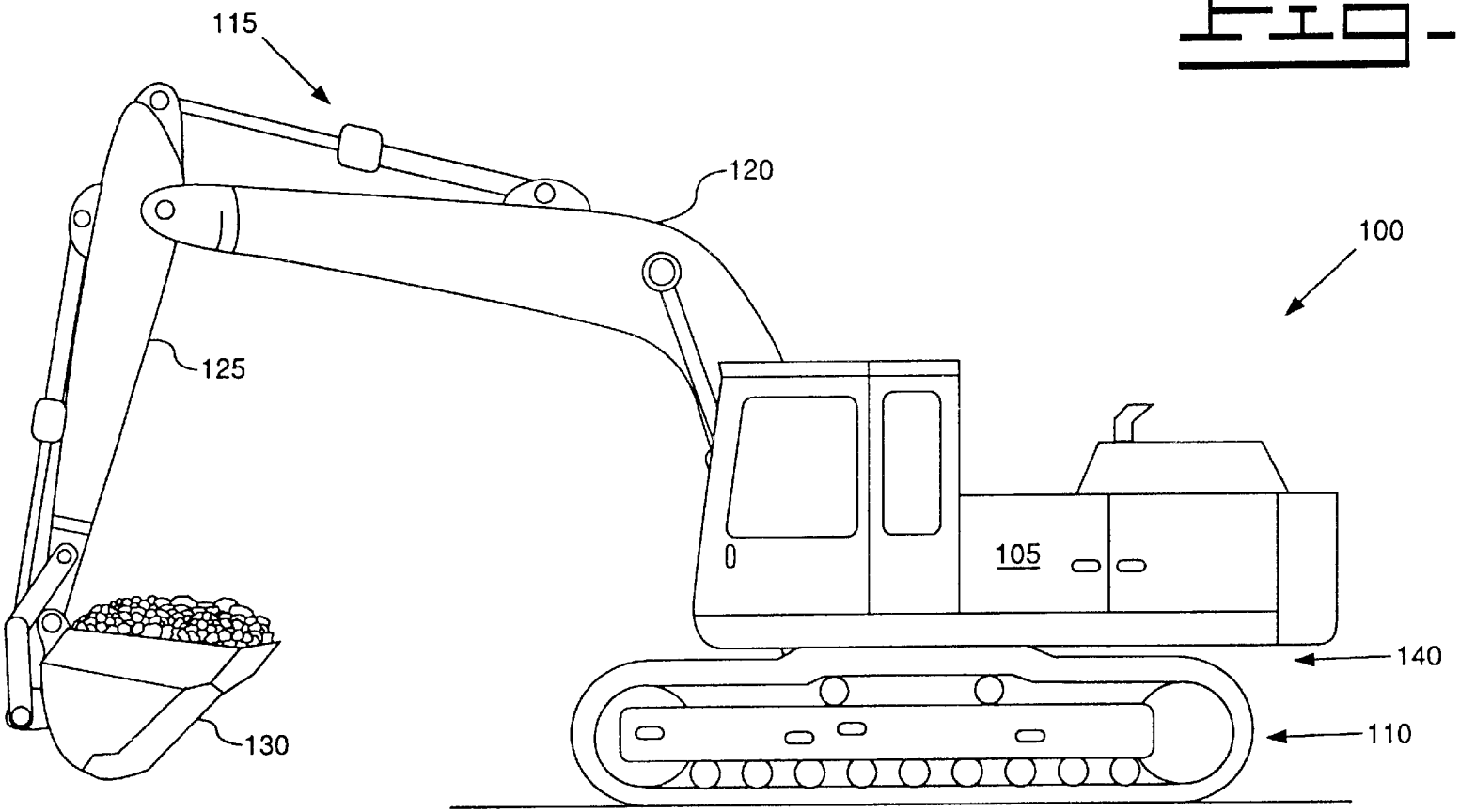
FIG. 1 illustrates a diagrammatic view of a hydraulic excavator.

A typical excavator 100 is shown in relation to FIG. 1. A housing 105 sits on top of an undercarriage 110. A work implement 115 is mounted on the housing 105. As shown, the work implement 115 includes a boom 120, stick 125, and bucket 130. A drive assembly 140 rotates the housing relative to the under carriage 110.

Figure 2:
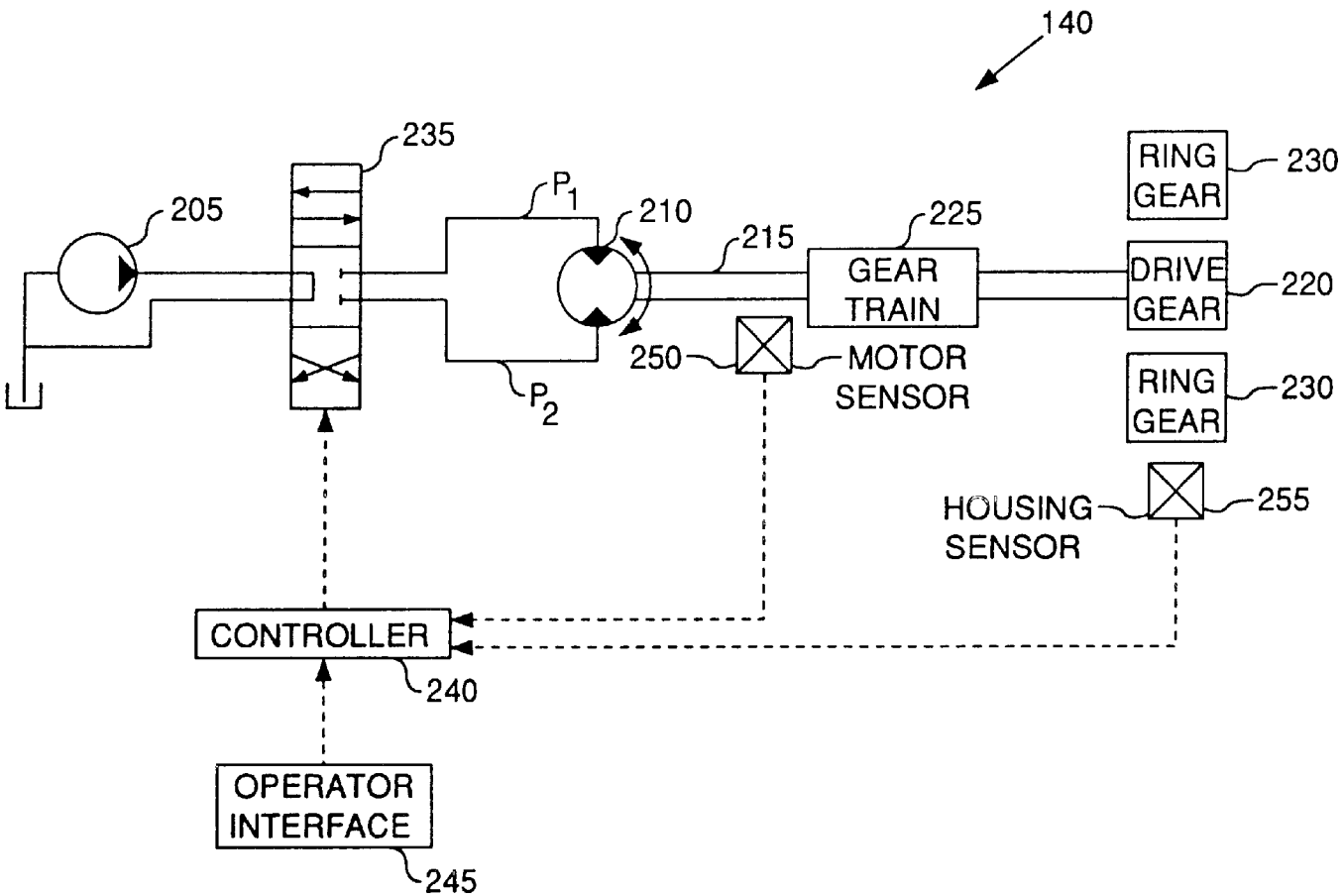
FIG. 2 illustrates an electrohydraulic circuit schematic associated with a drive assembly of the hydraulic excavator.

One example of a drive assembly 140 is shown in FIG. 2. A pump 205 supplies pressurized fluid to a hydraulic motor 210. In response to receiving the pressurized fluid, the motor rotates a drive shaft 215. The drive shaft 215 is coupled to a drive gear 220 via a gear train 225. The gear train 225 may comprise a plurality of planetary gear sets as is well known in the art. The drive gear 220 is meshed with a large ring gear 230 that is attached to the excavator undercarriage 110. Here, the drive gear 220 is shown as an extension of the excavator housing 105 and rotates about the large ring gear 230 to rotate the housing 105 relative to the undercarriage 110.

A three-way hydraulic control valve 235 regulates fluid flow both to and from the motor 210 via supply lines $P_1P_2$. Typically, the control valve 235 is operated by a pilot valve (not shown) that is controlled by an electronic controller 240. However, for the purposes of this discussion, the controller 240 is assumed to directly control the operation of the three-way valve 235. In the preferred embodiment, the controller 240 is a microprocessor based system that includes random access memory ("RAM") and read only memory ("ROM"), and utilizes arithmetic units for controlling processes. The controller 240 may receive commands from an operator interface 245. The operator interface 245 may include electronic joysticks that are adapted to produce command signals indicative of a desired velocity and/or position of the excavator housing 105. If automatic excavator control is desired, the controller itself may produce the desired position and/or velocity command signals.

The controller 240 receives position and/or velocity information from either a motor sensor 250 or a housing sensor 255. The motor sensor 250 produces motor position and/or velocity signals in response to the rotation of the drive shaft 215. The housing sensor 255 produces housing position and/or velocity signals in response to the rotation of the excavator housing 105. Thus, either can be equally used by the present invention, in that, each sensor produces signals that are indicative of the rotational position of the excavator housing 105. Note that, the position sensors 250,255 may include such well known devices as: Hall effect sensors, resolvers, tachometers, rotary potentiometers, or the like.

The position signal not only represents the position of the excavator housing 105, but additionally represents of velocity of the excavator housing 105. This is accomplished by the controller 240, which differentiates the position signal; thereby, producing a velocity signal. Alternatively, information representing the rotational velocity of the excavator housing 105 may be produced by utilizing an additional sensor (not shown).

Figure 3:
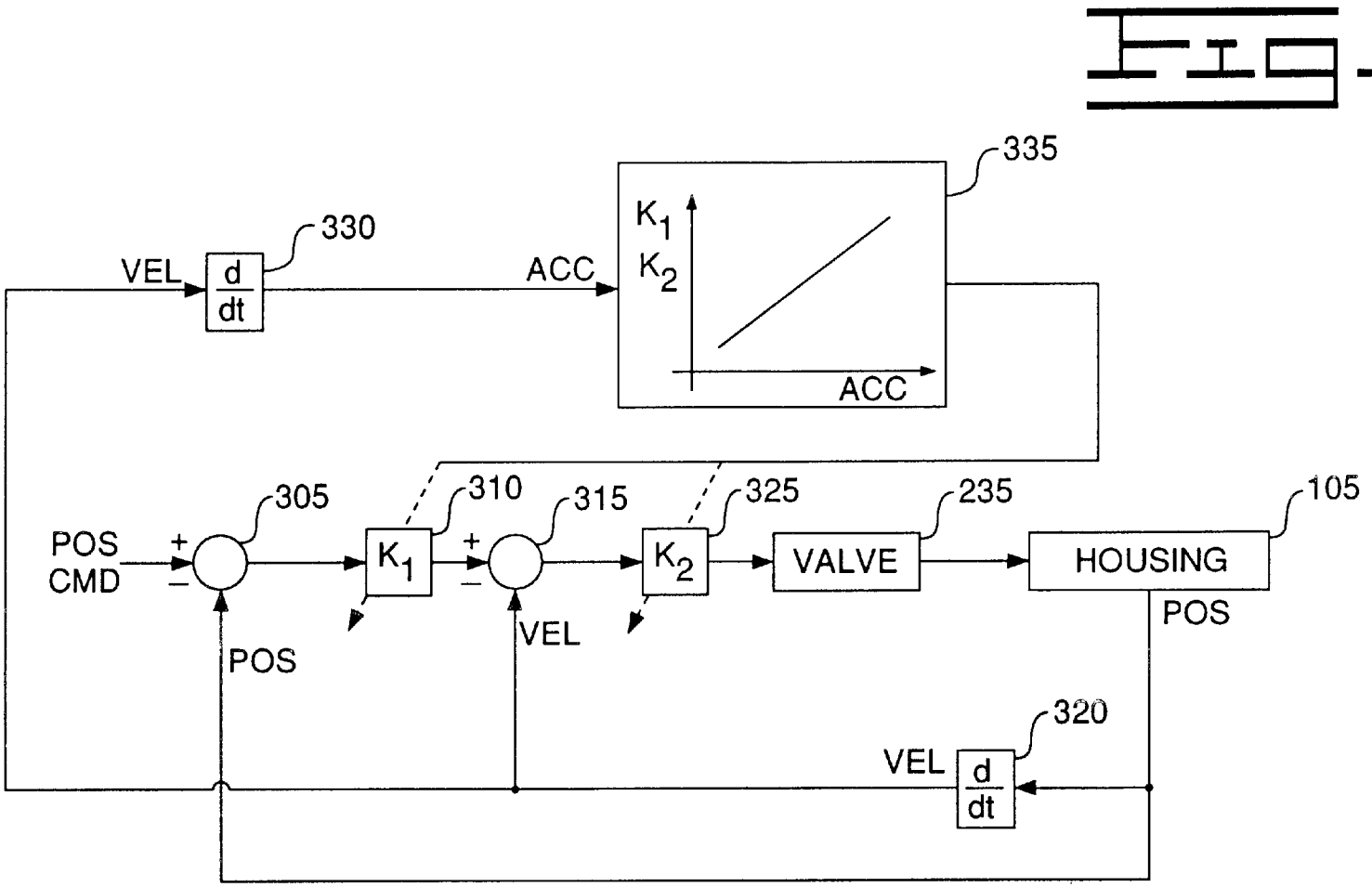
FIG. 3 illustrates a block diagram of a control system for controlling the drive assembly.

A block diagram of a control system used by the controller 240 is shown in relation to FIG. 3. A desired position signal is compared to an actual or reference position signal at a first summing junction 305, which produces a position error signal. The position error signal is multiplied by a position gain value at a first gain stage 310 to produce a desired or reference velocity signal. The desired velocity signal is compared to an actual velocity signal at a second summing junction 315, which produces a velocity error signal. The actual velocity signal is produced by differentiating the actual position signal at a first differentiating block 320. The velocity error signal is multiplied by a velocity gain value at a second gain stage 325 to produce a control signal. Accordingly, the control signal is delivered to the control valve 235 to controllably rotate the excavator housing 105 to the desired position at the desired velocity.

Advantageously, the present invention monitors the acceleration of the excavator housing 105 to account for inertial changes. More specifically, the acceleration of the excavator housing 105 is used to determine the position and velocity gain values. The excavator housing acceleration is determined by differentiating the actual velocity signal, at a second differentiating block 330. In the preferred embodiment, the excavator housing acceleration is determined by utilizing standard peak detection techniques, viz., sampling acceleration over a period of time. The result of the second differentiating block 330 is an acceleration signal, the magnitude of which is compared to values contained in a look-up table 335 in order to produce the position and velocity gain values.

The look-up table 335 represents a multi-dimensional look-up table located in the RAM or ROM of the controller 240 and is used to store a plurality of position and velocity gain values, $K_1$, $K_2$, that correspond to a plurality of acceleration signal magnitudes. The number of characteristics stored in memory is dependent upon the desired precision of the system. The controller 240 compares the acceleration signal magnitude with those values stored in memory and selects the corresponding desired position and velocity gain values, $K_1$, $K_2$. Interpolation may be used to determine the gain values in the event that the sensed values fall between the discrete values stored in memory. The table values are derived from simulation and analysis of empirical data. Although a look-up table is described, it is well known in the art that an empirical equation may readily be substituted for the look-up table if greater accuracy is desired. Consequently, the position and velocity gain values, $K_1$, $K_2$, are variable and are dependent upon the excavator housing acceleration. Because the gain values are reflective of the acceleration of the excavator housing 105, which is indirectly proportional to load inertial, the control system can more accurately control the position of the excavator housing 105.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

The advantages of the present invention are best illustrated by an example. Assume that the excavator 100 is excavating material at a work site, has acquired a full load in the bucket 130, and is rotating the excavator housing 105 clockwise to a dump location. The controller 240 controls the position of the valve 235 to deliver fluid flow to the motor 210, via supply line $P_1$, to rotate the housing 105 clockwise. The controller 240 receives excavator housing positional information, determines the housing rotational acceleration, and adjusts the control gains accordingly. Because the bucket 130 has a full load, the acceleration of the excavator housing will be relatively slow. Advantageously, the controller 240 will employ "low" or slow responding control gains to adjust for high inertial forces in order to accurately position the excavator housing 105 to the desired position with negligible overshoot. Once the bucket 130 has dumped the material, the controller 240 will control the position of the valve 235 to deliver fluid flow to the motor 210, via supply line $P_2$, to rotate the housing 105 counter-clockwise. However, because the bucket 130 is empty, the load will be negligible; thereby, allowing the housing 105 to rotate with relatively high acceleration. Accordingly, the controller 240 will employ "high" or quick responding control gains to adjust for low inertial forces in order to accurately position the excavator housing 105 to the desired position—again with negligible overshoot.

By using information relating to the excavator housing acceleration, the controller 240 can anticipate the effects of inertial forces acting on the mechanical system of the excavator; thereby, providing for the controller 240 to adapt the control gains in order to accurately position the excavator housing in a manner that lessens or eliminates a condition referred to as overshoot. Thus, the present invention maximizes machine performance by minimizing overshoot; thereby, resulting in high productivity. As described, the present invention is applicable to manual or automatic operation of the excavator. Moreover, the present invention may be applied to any precise positioning control of rotating inertia with varying loads.

Other aspects, objects and advantages of the present invention can be obtained from a study of the drawings, the disclosure and the appended claims.

I claim:

1. A method for rotatably positioning a housing of a machine, comprising the steps of:

detecting a rotational position of the housing and responsively producing an actual position signal;

receiving the actual position signal and responsively producing an actual velocity signal;

producing a signal indicative of a desired velocity of the housing;

receiving and comparing the desired and actual velocity signals, and producing a velocity error signal in response to the comparison; and multiplying the velocity error signal by a velocity gain value indicative of the housing acceleration to produce a control signal that controls the rotation of the housing at the desired velocity.

2. An apparatus for rotatably positioning a housing of a machine, comprising:

a pump for producing pressurized fluid;

a motor for receiving the pressurized fluid and responsively rotating the housing;

a control valve for regulating fluid flow from the pump to the motor;

a position sensor for detecting a rotational position of the housing and responsively producing an actual position signal;

means for producing a signal indicative of a desired position of the housing;

means for receiving the position signal, differentiating the position signal, and responsively producing a velocity signal indicative of the velocity of the housing; and a controller for comparing the desired and actual position signals, responsively producing a position error signal, multiplying the position error signal by a variable gain value representative of the housing acceleration and delivering a control signal to the control valve to rotate the housing to the desired position, and wherein the controller multiplies the variable gain value by the position error signal to produce a desired velocity signal, compares the desired velocity signal to the actual velocity signal, and produces a velocity error signal in response to the comparison.

3. An apparatus, as set forth in claim 1, wherein the controller multiplies the velocity error signal by a variable gain value and responsively produces a control signal to rotate the housing at the desired velocity.

4. An apparatus, as set forth in claim 3, including means for receiving the velocity signal, differentiating the velocity signal, and responsively producing an acceleration signal indicative of the rotational acceleration of the housing.

5. An apparatus, as set forth in claim 4, including means for determining the position and velocity variable gain values in response to the housing acceleration signal magnitude.

6. An apparatus, as set forth in claim 5, including a look-up table for storing a plurality of position and velocity gain values that correspond to a plurality of acceleration magnitudes.

7. An apparatus, as set forth in claim 6, wherein the controller compares the acceleration signal magnitude to the acceleration signal magnitudes stored in the look-up table and selects the corresponding position and velocity gain values.

8. A method for rotatably positioning a housing of a machine, comprising the steps of:

detecting a rotational position of the housing and responsively producing an actual position signal;

producing an actual velocity signal;

producing a signal indicative of a desired position of the housing;

producing a signal indicative of a desired velocity of the housing;

receiving and comparing the desired and actual position signals, and producing a position error signal in response to the comparison;

receiving and comparing the desired and actual velocity signals, and producing a velocity error signal in response to the comparison;

determining a rotational acceleration of the housing, and determining a position and velocity gain value in response to the housing acceleration;

multiplying the position gain value by the position error signal to produce the desired velocity signal; and multiplying the velocity gain value by the velocity error signal to produce a control signal that controls the rotation of the housing at the desired velocity to the desired position.

9. A method, as set forth in claim 8, including the steps of receiving the position signal, differentiating the position signal, and responsively producing the velocity signal.

10. A method, as set forth in claim 9, including the step of multiplying the position variable gain value by the position error signal to produce the desired velocity signal.

11. A method, as set forth in claim 10, including the steps of receiving the velocity signal, differentiating the velocity signal, and responsively producing an acceleration signal.

12. A method, as set forth in claim 11, including the step of storing a plurality of position and velocity gain values that correspond to a plurality of acceleration magnitudes in a lookup table.

13. A method, as set forth in claim 12, including the step of comparing the acceleration signal magnitude to the acceleration signal magnitudes stored in the lookup table and selecting the corresponding position and velocity gain values.

* * * * *